United States Patent [19]

Brown

[11] Patent Number: 5,025,696

[45] Date of Patent: Jun. 25, 1991

[54] PARTIALLY FRETTED FINGERBOARD

[76] Inventor: John M. Brown, 7482 Concord Blvd., Inver Grove Heights, Minn. 55076

[21] Appl. No.: 410,259

[22] Filed: Sep. 21, 1989

[51] Int. Cl.[5] ..... G10D 3/06

[52] U.S. Cl. ..... 84/314 R

[58] Field of Search ..... 84/314

[56] References Cited

U.S. PATENT DOCUMENTS

| | | | |
|---|---|---|---|
| 864,204 | 8/1907 | Skinnell | 84/314 R |
| 1,237,872 | 8/1917 | Crow | 84/314 R |
| 1,317,830 | 10/1919 | Sivard | 84/314 R |
| 1,637,559 | 8/1927 | Franic | 84/314 R |
| 3,894,468 | 7/1975 | Dunlap | 84/314 |
| 4,132,143 | 1/1979 | Stone | 84/314 |
| 4,137,813 | 2/1979 | Stone | 84/314 |
| 4,221,151 | 9/1980 | Barth | 84/314 |
| 4,249,450 | 2/1981 | Quemore | 84/317 |
| 4,334,456 | 6/1982 | Martin et al. | 84/314 |
| 4,430,918 | 2/1984 | Meno | 84/1.16 |
| 4,633,754 | 1/1987 | Chapman | 84/314 |
| 4,723,469 | 2/1988 | Vogt | 84/314 |
| 4,772,260 | 2/1988 | Pigozzi | 84/314 |
| 4,777,858 | 10/1988 | Petschulat et al. | 84/314 |
| 4,794,838 | 1/1989 | Corrigan III | 84/1.01 |

FOREIGN PATENT DOCUMENTS

| | | | |
|---|---|---|---|
| 498022 | 3/1937 | United Kingdom | 84/314 R |

*Primary Examiner*—Lawrence R. Franklin

*Attorney, Agent, or Firm*—Kinney & Lange

[57] ABSTRACT

A stringed instrument fingerboard having a first fretted portion and a first fretless portion in which frets would occur if the pattern of the fret locations in the fretted portion had been extended thereover.

9 Claims, 3 Drawing Sheets

11
12
13
14
15
16
17
18
20
21
22
23
24
25
26
27

27'
12
27'''
24
26''
26'
24
9
9
26'''
26
24
12
12
27''''
27''

PARTIALLY FRETTED FINGERBOARD

BACKGROUND OF THE INVENTION

The present invention relates to stringed instruments and, more particularly, to stringed instruments having a fingerboard therein.

Stringed instruments are of ancient origin. During the succeeding centuries, many forms of such instruments have been developed. Many of these instrument forms are configured having a relatively narrow neck structure. That neck structure very commonly has an end at which the instrument strings are attached in such a manner as to permit adjusting the tension thereof, and has another end affixed to a body on which a bridge or saddle is provided to secure the opposite ends of these strings. The neck typically also has a structural portion having an exposed surface below the strings which is referred to as a fingerboard.

In the development of such instruments, fingerboards have resulted therefor that are either of the fretted type, or the fretless type, depending on the particular instrument in which it is located. A fretted fingerboard has a series of elongated narrow structures spaced apart from one another that project above a larger, major fingerboard surface. Each member of this series of structures has its axis of elongation provided transversely to the major axis of the neck, and each is located at a precise location along the length of the fingerboard.

The purpose of these structures is to permit the musician using the instrument to shorten the effective length of the vibrating portion of a string positioned thereover. That musician is enabled to repeatedly select the effective lengths of the string at precise points, each of which is determined using the fret chosen by the musician for this purpose, to thereby alter the pitch or frequency of the sound produced by the vibrating string. If the musician stops the string against the fingerboard major surface on the side of the fret opposite the bridge or saddle, the string will also be stopped against that fret and a precise vibration frequency in the string can thus be set determined by the distance of the fret from that bridge or saddle.

In a fretless fingerboard, the string is stopped against the fingerboard surface by the musician wherever the musician chooses, and the resulting vibration frequency of that portion of the string between this stop point and the bridge or saddle is determined by the precise position of the point at which the string is stopped. Thus, there is no fret to stop the string against to provide a corresponding fixed frequency of vibration of the string and the vibration frequency will change slightly with slight shifts in the stop point chosen by the musician's finger placement.

As a result, the point at which the string is stopped in a fretless fingerboard is more critical in determining the resulting vibration frequency of the string than is the point at which it is stopped in a fretted fingerboard, the latter requiring only that the string be stopped behind the fret to give a known frequency associated with that fret. Hence, a considerably wider range of frequencies for a vibrating string can be selected by a musician playing a fretless fingerboard than can be selected by a musician playing a fretted fingerboard. In the latter situation, the number of different frequencies which can be provided by a string over a fretted fingerboard is, as a general matter, equal to the number of frets provided.

The set of available frequencies for a string, or available tones, are thus more or less fixed in number to a relatively few such tones over a fingerboard with frets. Those tones, or frequencies, are determined by the distance between each of the frets provided and that means used for affixing the other end of the strings to the instrument body, such as a bridge or saddle. The set of these tones available for a string in a fretted fingerboard is termed its tonal scale. This tonal scale is predetermined by the placement of the frets along the fingerboard, and a substantial number of possible placements and tone scales are possibilities from which to choose. A common choice for guitars, for instance, is the so-called "equal tempered scale" which corresponds to a particular pattern of placements of the frets along the fingerboard.

However, other tonal scales are employed in some kinds of music. Thus, there is a desire for alternative tonal scales being available for a stringed instrument having a fingerboard with frets. Although these can be provided easily enough by a musician playing a fretless fingerboard, a fretted fingerboard having permanently emplaced frets presents a much more difficult problem. Among the solutions offered for this problem are substitutable fingerboards and movable frets. These are obviously at least somewhat time consuming in being implemented for each newly chosen tonal scale.

In addition, certain playing techniques for varying pitch are desired to give unusual acoustical results, particularly in jazz and rock music. Also, in such music, other kinds of sounds are desired to be generated which result from "slapping" the strings with the thumb or "popping" the strings by pulling on them. New sounds from these methods will result when used on a fretless fingerboard differing from the sounds obtained using them on a fretted fingerboard as has been done traditionally, but these new sounds are desired in conjunction with the ability to provide the fixed tones available from a fretted fingerboard. Thus, there is a desire to provide a fingerboard in which all of these capabilities are present and available to a musician.

SUMMARY OF THE INVENTION

The present invention provides a fingerboard having a first fretted portion at a corresponding string surface position in which the frets are repeated at locations therein following a selected pattern, and a first fretless portion at a corresponding string surface position in which fret portions would occur if the pattern of the fret locations in the first fretted portion had been extended over the first fretless portion. The frets can be sufficiently raised so that the ends thereof just intersect a projection thereacross of the surface of the first fretless portion. The first fretted and first fretless portion can extend under more string positions and can do so to the extent of being across the entire fingerboard. Additional fretted and fretless portions may also be provided.

DESCRIPTION OF THE PREFERRED EMBODIMENTS

Figures 1, 4:
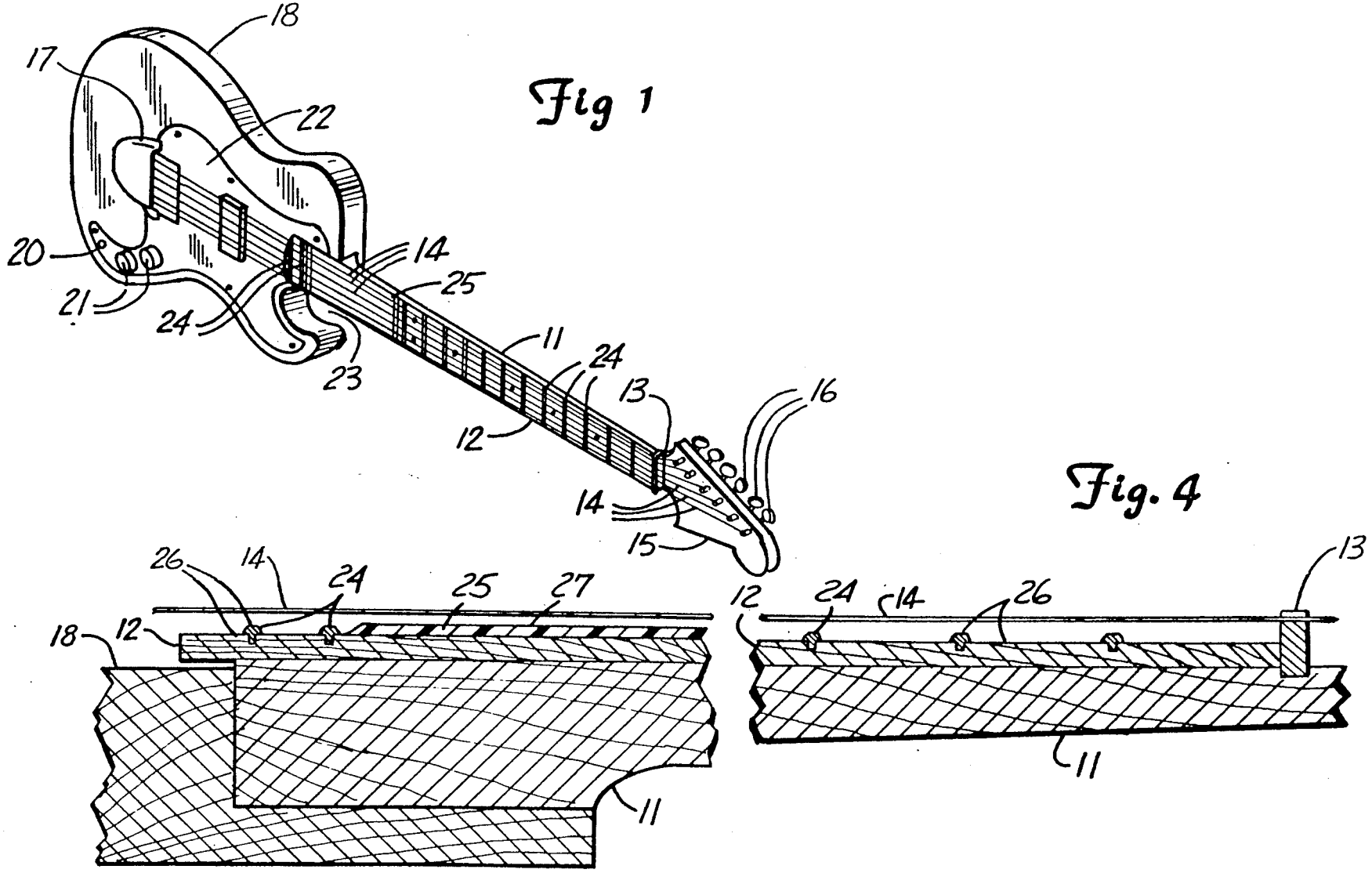
FIG. 1 is a pictorial view of a stringed instrument embodying the present invention.
FIG. 4 is a cross section view of part of the portion shown in FIG. 3, FIGS. 5, 6, 7, and 8 are top views of alternatives to the portion of FIG. 3.

FIG. 1 shows a pictorial view of an electric guitar, 10, embodying the present invention. Guitar 10 has a neck 11, toward the right on which is provided a fingerboard, 12. Fingerboard 12 may be a separate structural component affixed to the neck or it may be merely an exposed surface of a single component, integral neck structure. At the right-hand end of guitar 10 in FIG. 1, there is provided a nut, 13, at the end of fingerboard 12. Strings, 14, extend over nut 13 to the head portion of the neck, 15, in which are provided a plurality of tuning means, 16, one of each for a corresponding one of strings 14, and which are provided for adjusting the tension of the corresponding one of those strings.

At the other end of neck 11 in FIG. 1, strings 14 are held by a bridge, or saddle, shown under a bridge cover, 17, which bridge is attached to a body, 18, of guitar 10. Acoustical sensors, 19, are provided below strings 14 to sense the acoustical energy therefrom. This sensed acoustical energy is converted to corresponding electrical signals by sensors 19, and provided through appropriate electronic circuitry to an output jack, 20, from which these signals can be provided to an amplification system not shown. Control adjustment knobs, 21, are provided to control volume and tone. A pick guard, 22, is affixed to the surface of body 18 under strings 14 and around sensors 19, output jack 20 and control knobs 21. A notched region, 23, is provided in body 18 to accommodate a musician's hand.

A plurality of frets, 24, are shown mounted in fingerboard 12 in FIG. 1. These can be more easily seen in the side view shown in FIG. 2 of a portion of neck 11 with fingerboard 12 thereon. There, frets 24 can be seen to be spaced apart and partially embedded in fingerboard 12, the locations of frets 24 being set in a spatial pattern along the major axis thereof corresponding to the desired tonal scale. However, this pattern of placement of frets 24 is interrupted along this axis of fingerboard 12 in part by the provision of an increased elevation region of this fingerboard, 25, which is devoid of any frets being inserted therein. As a result, fingerboard 12 has two fretted surface portions therealong each comprising together the surfaces of frets 24 and the major surface portions of fingerboard 12 where frets 24 are not present. These fretted surface portions are separated by a fretless surface portion on fingerboard 12 comprising the exposed surface of elevated region 25.

Figure 2:
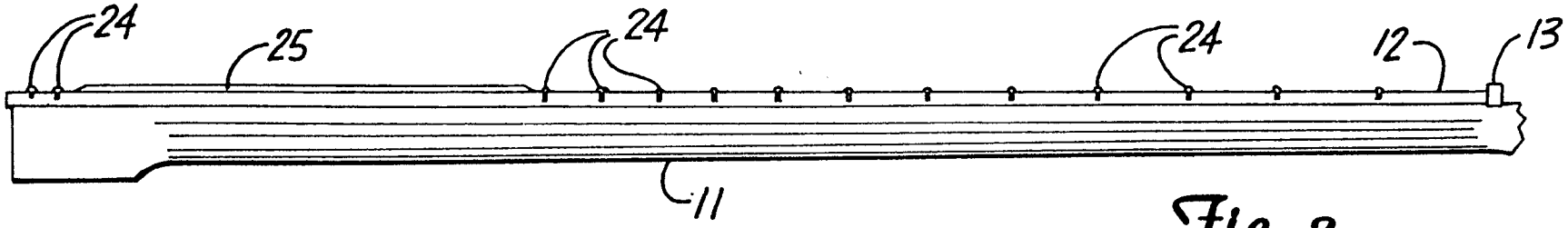
FIG. 2 is a side view of a portion of the instrument of FIG. 1.
Figure 3:
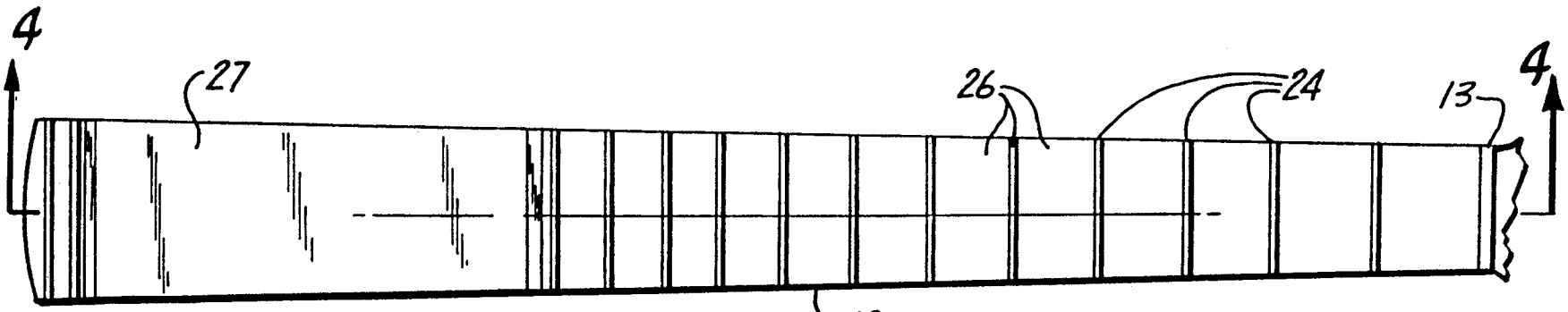
FIG. 3 is a top view of the portion shown in FIG. 2.

The top view of the structure shown in side view in FIG. 2 is further shown in a top view shown in FIG. 3. This view shows the two fretted surface portions, 26, as separated by the fretless surface portion, 27. Although strings 14 are omitted from the views shown in FIGS. 2 and 3, they can be seen in FIG. 1 over surface portions 26 and 27 in each of which there is a corresponding string location over which one of strings 14 passes. Thus, any one of strings 14 passes over both fretted surface portions 26 and over fretless surface portion 27 in the version shown in FIG. 1.

Because of the presence of both fretted and fretless surface portions on fingerboard 12, a musician playing guitar 10 can provide sounds of both a fretted stringed instrument and a fretless stringed instrument concurrently, and can also switch quickly between either if desired. These possibilities provide such a musician a much greater range of sound than is otherwise available on a conventional guitar.

In the configuration shown in FIGS. 1 through 3, the fretted region to the left having two of frets 24 therein is provided especially for musicians playing "funk" style music. These frets aid in allowing such musicians to render sounds based on a "slapping" methodology of energizing strings 14, and a "popping" methodology involving pulling on strings 14.

The construction of a portion of neck 11 and fingerboard 12, including fretted surface portions 26 and fretless surface portions 25, can be better seen in the cross section view of FIG. 4 taken from FIG. 3. There, as can be seen, fingerboard 12 is shown as a separate structural component of neck 11 rather than being an integrally formed part thereof. Neck 11 is shown fitted into body 18, and strings 14 are shown in FIG. 4 even though they have been omitted in FIG. 3. Primarily to be noted is that the tops of frets 24 are the same height above the major surface portions of fingerboard 12 therearound as is the top of elevated portion 25. That is, a projection of the surface of elevated portion 25 serving as fretless surface portion 27 over fretted surfaces 26 would lead to the tops of frets 24 just meeting this projection of fretless surface portion 27.

This commonality of height above fingerboard 12 of the exposed surface of elevated portions 25 serving as fretless surface portion 27 and the tops of frets 24, serving as the peaks of fretted surface portions 26, is important to the musician using guitar 10 in enabling that person to smoothly make the transition from operating it as a fretted instrument to operation as a fretless instrument, and vice versa, or in operating it as both a fretted and fretless instrument in some circumstances.

In FIGS. 1 through 4, the larger fretted surface portion 26 is located so that the lower octave of the tonal scale is available from this portion. In what would be the higher octave, if the positioning pattern of frets 24 in fretted surface portions 26 were continued in placing frets in what is fretless portion 27, is thus occupied by fretless portion 27 except for the two frets 24 in the smaller of fretted surface portions 26. However, this arrangement could be reversed, as is shown by fretted surface portion, 26', and a fretless surface portion, 27', in FIG. 5, an arrangement which gives a musician using guitar 10 an alternative range of sounds which may be more suitable for his purpose at some times. Further, if the "slapping" and "popping" methodologies are unneeded, the smaller of fretted surface portions 26 in FIG. 1 through 4 can be omitted leading to an enlarged fretless surface portion, 27'', shown in FIG. 6.

Several other useful combinations of fretted and fretless surface portions can also be constructed depending on the desires of the musician intending to use guitar 10 with such a structure. For instance, some of strings 14 can have the positions on fingerboard 12 thereunder entirely fretted while others will have only portions of fingerboard 12 thereunder fretted and other portions fretless. Such a result is shown in FIG. 7 where a fretted surface portion, 26'', extends for the length of fingerboard 12 but extends entirely transversely across fingerboard 12 in only part thereof leaving a much reduced fretless surface portion, 27'''.

Figures 5, 6, 7, 8:
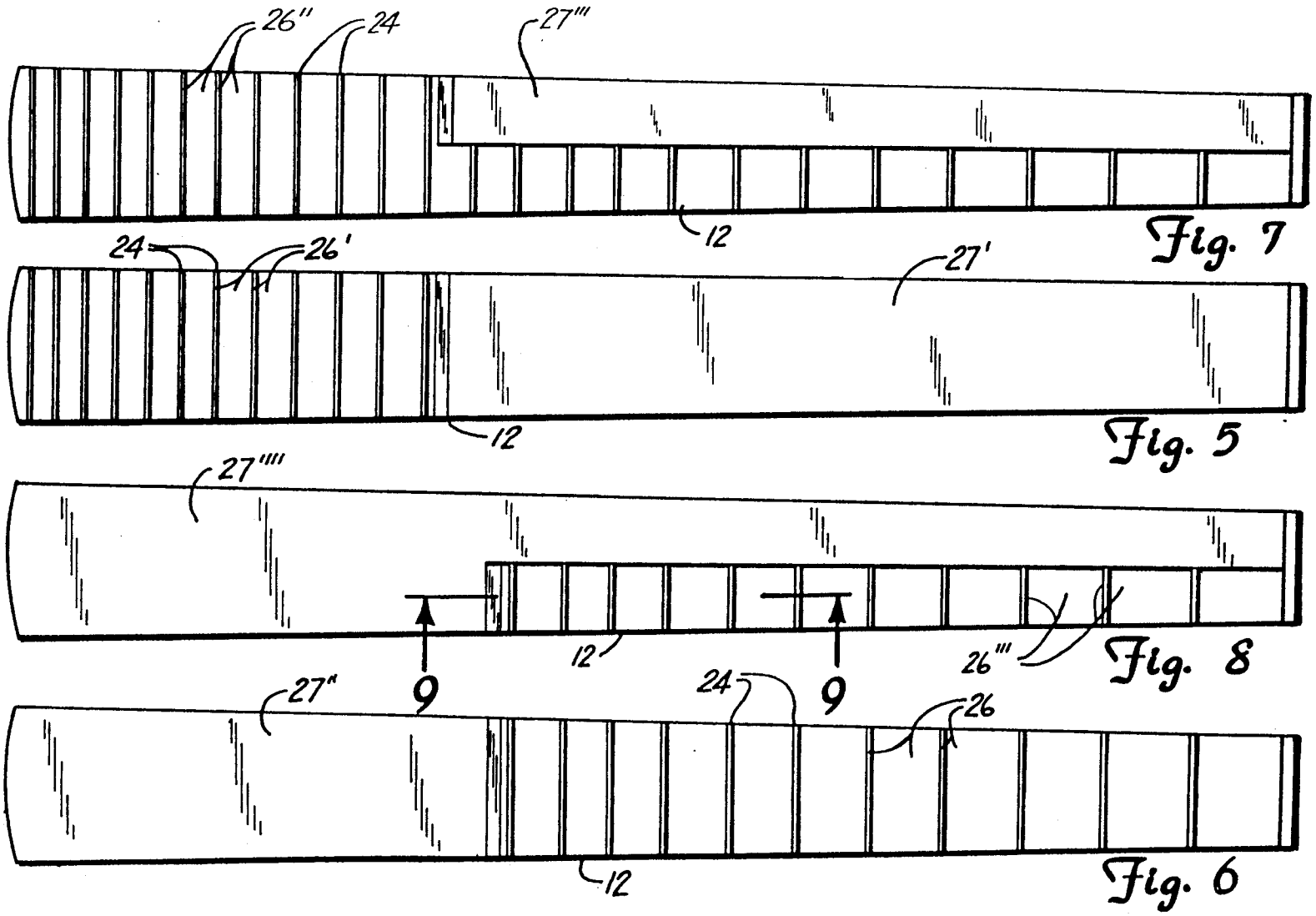

The opposite proportion of fretted and fretless surface portions can be just as well provided as is shown in FIG. 8. There, a fretless surface portion, 27''', extends the entire length of fingerboard 12 and extends entirely transversely across fingerboard 12 in only part thereof. A fretted surface portion, 26''', extends for part of the length of fingerboard 12 and would be under only some of strings 14 in guitar 10.

Figure 9:
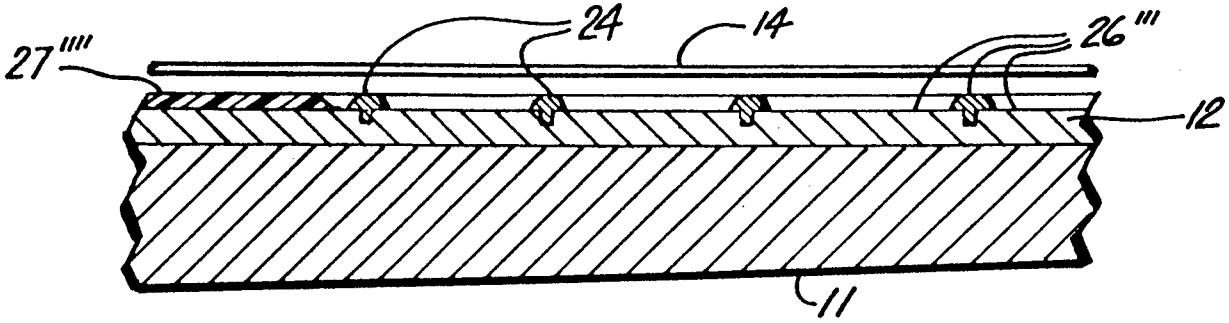
FIG. 9 is a cross section view of part of the portion shown in FIG. 8.

A cross section view taken from FIG. 8 is shown in FIG. 9. There, the principle of keeping the fretless surface portion at the same height as the top of frets 24 in the fretted surface portion is shown clearly maintained. Fretless surface portion 27'''' can be seen to have its projection toward the viewer be at the same height as the top of frets 24 in fretted surface portion 26'''. Again, this is a great aid to a musician in being able to make unimpeded transitions between fretted surface portion 26''' and fretless surface portion 26''''. Further combinations of fretless surface portions and fretted surface portions can be provided to meet the particular needs of musicians, beyond those shown in the present figures, and still maintain having the fretless surface portion projections just intersect the tops of frets 24 in the fretted surface portions.

Although the present invention has been described with reference to preferred embodiments, workers skilled in the art will recognize that changes may be made in form and detail without departing from the spirit and scope of the invention.

What is claimed is:

1. A fingerboard of a stringed instrument having a longitudinal dimension along which a plurality of strings extend between a tension bridge and a nut on said instrument, said fingerboard comprising:

a fretted portion which extends transversely across said fingerboard beneath at least one but less than all of said strings, the frets of said fretted portion rising a selected height above said fingerboard and being spaced apart according to a selected tonal pattern; and a fretless portion of said fingerboard extending transversely across said fingerboard beneath at least one but less than all of said strings, said fretless portion of said fingerboard having a relatively smooth surface and extending longitudinally along said fingerboard sufficiently to cover an area in which a plurality of consecutive frets would have otherwise occurred if said pattern of frets had been maintained in said fretless portion.

2. The fingerboard of claim 1 wherein said relatively smooth surface of said fretless portion is the same height above said fingerboard as said frets.

3. The fingerboard of claim 2 wherein said stringed instrument is an electric guitar.

4. A fingerboard of a stringed instrument having a longitudinal dimension along which a plurality of strings extend between a tension bridge and a nut on said instrument, said fingerboard comprising:

a first fretted portion of said fingerboard wherein said first fretted portion includes a first plurality of consecutive frets extending transversely across said fingerboard beneath all of said strings and spaced longitudinally along said fingerboard in a selected tonal pattern;

a first fretless portion extending transversely across said fingerboard beneath all of said strings, said first fretless portion having a relatively smooth surface and extending longitudinally along said fingerboard sufficiently to cover an area in which a plurality of consecutive frets would have otherwise occurred if said pattern of frets in said first fretted portion had been maintained in said first fretless portion; and a second fretted portion of said fingerboard separated from said first fretted portion by said first fretless portion, said second fretted portion of said fingerboard including a second plurality of consecutive frets extending transversely across said fingerboard beneath all of said strings and spaced longitudinally along said fingerboard so as to maintain said selected tonal pattern as extended from said first fretted portion.

5. The fingerboard of claim 4 wherein a second fretless portion is provided extending transversely across said fingerboard beneath all of said strings, and is separated from said first fretless portion by said first fretted portion, said second fretless portion having a relatively smooth surface and extending longitudinally along said fingerboard sufficiently to cover an area in which a plurality of consecutive frets would otherwise have occurred if said pattern of frets in said first fretted portion had been maintained in said second fretless portion.

6. The fingerboard of claim 5 wherein said frets rise a selected height above said fingerboard and wherein said relatively smooth surfaces of said fretless portions are the same height above said fingerboard as said frets.

7. The fingerboard of claim 6 wherein said stringed instrument is an electric guitar.

8. The fingerboard of claim 4 wherein said frets rise a selected height above said fingerboard and wherein said relatively smooth surface of said first fretless portion is the same height above said fingerboard as said frets.

9. The fingerboard of claim 8, wherein said stringed instrument is an electric guitar.

* * * * *